US007157841B2

(12) United States Patent
Yonezawa et al.

(10) Patent No.: US 7,157,841 B2
(45) Date of Patent: Jan. 2, 2007

(54) ELECTRON TUBE HAVING LINEAR DAMPER

(75) Inventors: Yoshihisa Yonezawa, Chiba (JP); Yasuhiro Nohara, Chiba (JP); Hiroaki Kawasaki, Chiba (JP)

(73) Assignee: Futaba Corporation, Mobara Chiba (JP)

( * ) Notice: Subject to any disclaimer, the term of this patent is extended or adjusted under 35 U.S.C. 154(b) by 145 days.

(21) Appl. No.: 10/791,899

(22) Filed: Mar. 4, 2004

(65) Prior Publication Data

US 2004/0183429 A1 Sep. 23, 2004

(30) Foreign Application Priority Data

Mar. 5, 2003 (JP) ..... 2003-059087

(51) Int. Cl.
*H01J 1/88* (2006.01)
*H01J 19/42* (2006.01)
*H01K 1/18* (2006.01)

(52) U.S. Cl. ..... 313/271; 313/269; 313/272; 313/275

(58) Field of Classification Search ..... 313/269, 313/271–279
See application file for complete search history.

(56) References Cited

U.S. PATENT DOCUMENTS 6,135,620 A * 10/2000 Marsh ..... 362/377
2002/0121857 A1* 9/2002 Yonezawa et al. ..... 313/495
2003/0030378 A1* 2/2003 Kawasaki et al. ..... 313/632

FOREIGN PATENT DOCUMENTS

JP 59-146139 * 8/1984

* cited by examiner

*Primary Examiner*—Joseph Williams
*Assistant Examiner*—Bumsuk Won
(74) *Attorney, Agent, or Firm*—Bacon & Thomas, PLLC

(57) ABSTRACT

An electron tube includes a vessel, a primary linear member installed in the vessel, an electrode disposed in the vessel, a first auxiliary linear member and a second auxiliary linear member disposed at different heights to interpose the primary linear member therebetween, and a plurality of fixing members. The fixing members are formed at a single substrate for constituting a part of the vessel, for fixing end portions of the first auxiliary and the second auxiliary linear member thereto.

25 Claims, 13 Drawing Sheets

ELECTRON TUBE HAVING LINEAR DAMPER

FIELD OF THE INVENTION

The present invention relates to an electron tube, for instance, a fluorescent display tube having a linear member such as a cathode filament, a linear grid and a linear getter; and, more particularly, to a fixing structure of an auxiliary linear member, such as a linear damper and a linear spacer, for restricting the movement of the linear member.

BACKGROUND OF THE INVENTION

Referring to FIGS. 11A to 13, a conventional electron tube, e.g., a conventional fluorescent display tube, will now be described in detail. Like reference numerals in FIGS. 11A to 13 represent like parts and, if there are a plurality of same elements, only one will be designated by a reference numeral.

FIGS. 11A and 11B show a prior art fluorescent display tube equipped with a plurality of pairs of insulating supports (dampers) such as a metal line coated with an insulator or a glass fiber, wherein the dampers are correspondingly arranged at an upper and a lower side of a cathode filament, respectively, thereby forming a pair (see, for instance, Japanese Patent Laid-Open Publication No. 1984-146139, in particular FIG. 3).

FIGS. 11A and 11B present a cross sectional view seen in a direction indicated by arrows after cutting along a line X2—X2 of FIG. 11B and a top view seen in a direction indicated by arrows after cutting along a line X1—X1 of FIG. 11A, respectively.

The prior art fluorescent display tube includes a front substrate 11 and an anode substrate 12 facing each other. Formed on inner surfaces of the front substrate 11 and the anode substrate 12 are a transparent conductive film 111 and an anode electrode 121 coated with a fluorescent substance, respectively. There are provided between the two substrates 11, 12 a cathode filament 21 and a grid 24 for controlling electrons emitted from the filament 21. The electrons emitted from the cathode filament 21 cause the fluorescent substance of the anode electrode 121 to radiate light.

In case the fluorescent display tube has a lengthy filament 21 or is mounted on an automobile, the filament 21 may vibrate and may come into contact with other components or the substrates of the display tube. In order to prevent such contact, there are disposed a plurality of pairs of dampers 221 and 222, wherein the dampers 221, 222 are correspondingly arranged at the upper and the lower side of the filament 21, respectively. The pairs of dampers are spaced apart from each other at a predetermined interval.

Referring to FIGS. 12A and 12B, there are shown another prior art fluorescent display tube including a front substrate where a plurality of dampers made of a metal line are arranged at one side of a cathode filament (see, for example, Japanese Patent Laid-Open Publication No. 2002-245925, in particular FIG. 5), wherein FIG. 12A is a cross sectional view seen in a direction indicated by arrows after cutting along a line X4—X4 of FIG. 12B; and FIG. 12B is a top view seen from a direction indicated by an arrow X3 shown in FIG. 12A.

The damper 22 made of a metal line is installed at one side of the filament 21, such that one end of the damper 22 is interposed between a metal layer 31 such as an aluminum thin film formed on the front substrate 11 and a metal piece 32 such as an aluminum wire, by an ultrasonic bonding to thereby wedge one end of the damper 22 by the metal layer 31 together with the metal piece 32. The damper 22 has a predetermined vertical position maintained by a use of a spacer 33 made of, e.g., a metal line.

In the first prior art display tube, an issue of how to fix ends of the dampers 221, 222 installed at both sides of the filament 21 is addressed. As one method of fixing the dampers 221, a scheme depicted in FIG. 13 can be conceived by adopting the fixing method of the second prior art display tube shown in FIGS. 12A and 12B (the scheme has not been disclosed).

As illustrated in FIG. 13, a lower damper 221 is fastened to a front substrate 11, while an upper damper 222 is fastened to an anode substrate 12. The damper 221 has both ends fixedly attached to a pair of metal layers 311 together with a corresponding pair of the metal pieces 321 by using the ultrasonic bonding technique. Similar to the damper 221, both ends of the damper 222 are fixedly attached to a pair of metal layers 312 with the metal pieces 322 by the same bonding technique.

In this case, the fixing process of the dampers 221, 222 is repeatedly performed at four locations in the front substrate 11 and the anode substrate 12. For this reason, a space for installing the metal layers 311, 312 and the spacers 331, 332 is enlarged, thereby increasing so-called dead space which is not useful in a display function of the fluorescent display tube. In addition, since manufacture and installation processes of the metal layers 311, 312 and the spacers 331, 332 increase and a large number of members are needed therefor, the production costs of the fluorescent display tube may rise. Further, in case of providing the dampers 221, 222 with wirings, the wirings need to be prepared in the front substrate 11 and the anode substrate 12 separately, which in turn doubles the number of wirings and terminals needed therefor.

SUMMARY OF THE INVENTION

It is, therefore, an object of the present invention to provide an electron tube capable of reducing a space for fixing one or more pairs of auxiliary linear members, the number of process and member therefor, and the number of wiring thereof and terminal for extracting the wirings to an outside by fixing one or more pairs of auxiliary linear members to a common fixing member or separated fixing members formed on a same substrate.

In accordance with the present invention, there is provided an electron tube comprising:

a vessel;

a primary linear member installed in the vessel;

an electrode disposed in the vessel;

a first auxiliary linear member and a second auxiliary linear member disposed at different heights to interpose the primary linear member therebetween; and a plurality of fixing members, formed at a single substrate for constituting a part of the vessel, for fixing end portions of the first auxiliary and the second auxiliary linear member thereto.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENT

Figure 1A:
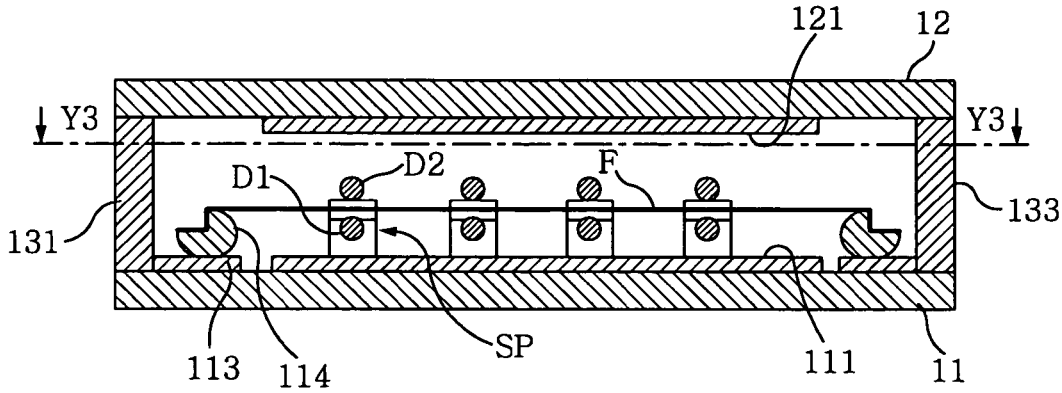
FIGS. 1A to 1C illustrate a fluorescent display tube in accordance with a preferred embodiment of the present invention.

Referring to FIGS. 1 to 10, a fluorescent display tube of an electron tube type in accordance with a preferred embodiment of the present invention will now be described in detail. Like reference numerals in the drawings represent like parts and, if there are a plurality of same elements, only one will be designated by a reference numeral.

Figure 1B:
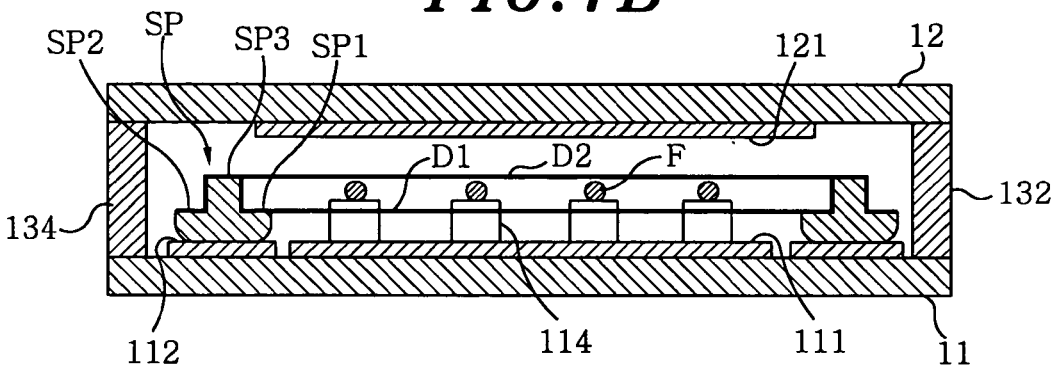
Figure 1C:
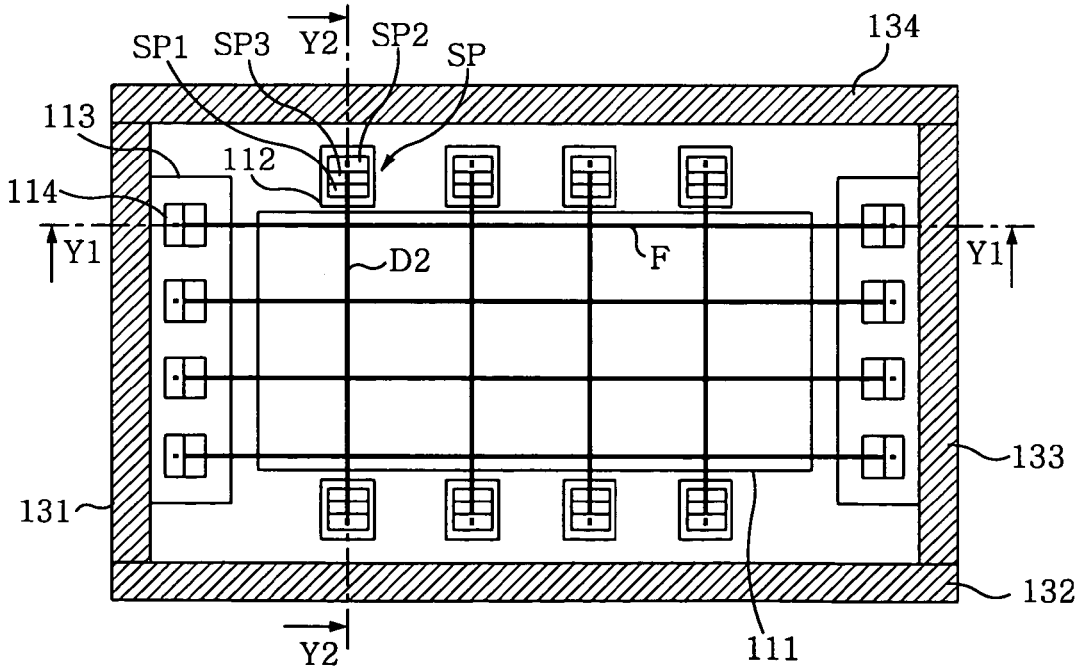

FIGS. 1A to 1C show a fluorescent display tube in accordance with the preferred embodiment of the present invention, wherein FIG. 1A offers a cross sectional view seen in a direction indicated by arrows after cutting along a line Y1—Y1 of FIG. 1C; FIG. 1B, a cross sectional view seen in a direction indicated by arrows after cutting along a line Y2—Y2 of FIG. 1C; and FIG. 1C, a top view seen in a direction indicated by arrows after cutting along a line Y3—Y3 of FIG. 1A.

The fluorescent display tube includes a sealed vessel (a container) provided with at least a front substrate 11 and an anode substrate 12 (a first substrate and a second substrate, respectively), wherein the substrates 11, 12 are made of an insulating material such as glass or the like and disposed to face each other. The front substrate 11 and the anode substrate 12 are hermetically sealed by using side plates 131 to 134 made of an insulating material such as glass and fritted glass(not shown) to thereby form the sealed vessel. The sealed vessel can be formed by hermetically sealing the substrates 11, 12 by using only the fritted glasses without using the side plates 131 to 134(in the case, the vessel or the fritted glass include a spacer). Thus, the side plates 131–134 and the fritted glasses will be referred to as side members.

There are formed on inner surfaces of the front substrate 11 and the anode substrate 12 a transparent conductive film (NESA electrode) 111 and a plurality of anode electrodes 121 on which a fluorescent substance (not shown) is applied. Disposed between the substrates 11 and 12 are hot cathode filaments F (linear members) and a pair of conductive dampers D1, D2 (auxiliary linear members disposed above and below the linear members) for preventing the vibration of the filaments F. The pair of linear dampers D1, D2 symmetrically arranged with respect to the filament F are hung tightly in a direction intersecting the filaments F and a plurality of such pairs are installed along a longitudinal direction of the filaments F at a predetermined interval.

Electrons discharged from the filaments F excite the fluorescent substance applied on a selected anode electrode 121, thereby making the fluorescent substance radiate light. By applying a predetermined voltage to the transparent conductive film 111 on the front substrate 11, the front substrate 11 is prevented from being charged with electricity and, at the same time, the electrons from the filaments F can be uniformly diffused to the selected anode electrode 121.

The pair of corresponding dampers D1, D2 are symmetrically arranged below and above the filaments F respectively and are kept out of contact with the filament F when the filaments F are not vibrated. In case that the filaments F vibrate due to a shock from the outside, the filaments F come into contact with the dampers D1, D2, which serve to stop the filament F from vibrating, thereby preventing the filament F from being in contact with, e.g., the anode electrode 121. The linear electrode such as the filaments F, to which a voltage is applied (to heat same), is preferably disposed in such a manner to be in contact with the dampers D1, D2, only when the linear electrode is vibrates. Otherwise, under a constant contact with the dampers D1, D2, the filament F loses heat through the dampers D1, D2, which in turn reduces the electron emission at the contact portion and results in a deterioration of the display quality. A linear member to which a voltage is not applied may be in contact with the dampers all times.

Both ends of each of the damper D1, D2 are fixed to conductive spacer pads SP (fixing members) made of an aluminum wire such as a bonding wire. The spacer pads SP are ultrasonically bonded to aluminum thin films (metal layers) 112 formed on the front substrate 11. One end of the damper D1 is embedded in a fixing portion SP1, specifically, between a bottom portion and a vertical portion thereof, by the ultrasonic bonding, wherein the fixing portion SP1 having a step shape is located in an offset position of the spacer pad SP. In the same manner, one end of the damper D2 is fixed to a fixing portion SP2 of the spacer pad SP. Herein, the ends of each damper can be embedded in such manners that: ① the whole end portion placed in the fixing portion is completely embedded, such that a surface thereof not exposed to the outside; ② the end portion is partially embedded, such that parts of the surface thereof is exposed to the outside; and ③ a part of the end portion is completely embedded not to be exposed therefrom, whereas the remaining part thereof is partially embedded, such that parts of the surface thereof is exposed to the outside (combination of ① and ②).

The vertical position of the damper D1 is defined by the height of the bottom portion of the fixing portion SP1, while that of the damper D2 is defined by the height of a top portion SP3 thereof. The height of the top portion SP3 serving as a spacer portion depends on the diameter of the Al wire constituting the spacer pad SP.

Both ends of the filament F are fastened to step-shaped fixing portions of conductive spacer pads 114 made up of an aluminum wire (a bonding wire) by using the ultrasonic bonding. The spacer pad 114 is ultrasonically bonded to an aluminum thin film (a metal layer) 113 of a cathode wiring formed on the front substrate 11. The vertical position of the filament F is determined by the diameter of the Al wire.

The first exemplary display tube has the pair of dampers D1, D2 capable of being fastened only to the front substrate 11 (a same substrate) and, further, one spacer pad SP is used for fixing the corresponding ends of the two dampers D1, D2. Since the spacer pad SP functions both as the fixing member and the spacer, there is no need to prepare the two members separately as in the conventional display tubes. Further, the spacer pad SP is a single member but can define two different vertical positions.

The whole part or a large part of the end portions of the dampers D1, D2 are embedded in the spacer pads SP along the bottom portions and the vertical portions of the stepped-shaped fixing portions SP1, SP2 thereof, respectively. Since this allows an area of the end portions of the dampers D1, D2 joined to the spacer pads SP to be enlarged, the dampers D1, D2 have sufficient portions joined thereto thereby increasing the binding strength.

In case of providing the dampers D1, D2 with the wirings, one wiring or one terminal for extracting the wiring can be commonly used for both dampers D1, D2, as will be described later, and, therefore, it is not required to increase the numbers thereof.

Furthermore, FIGS. 1A to 1C represent a diode without installing a grid between the filament F and the anode electrode 121. However, multi electrode tube having one or more grids between the damper D2 and the anode electrode 121 can be employed.

Hereinafter, the preferable size of each part of the fluorescent display tube of FIGS. 1A to 1C will now be explained.

The front substrate 11 and the anode substrate 12 both have a thickness ranging from about 0.9 to 1.1 mm and the distance between the substrates 11, 12 ranges from about 0.9 to 1.1 mm. The dampers D1, D2 are constituted by a metal line, made of, e.g., tungsten, having a diameter of about 0.03 mm (about 2 MG), and the spacer pad SP is constituted by an Al wire with a diameter of about 500 μm. Further, when the vertical position of the filament F is changed, the diameter of the Al wire of the spacer pad SP is required to be changed accordingly.

The spacer pad 114 is made of the Al wire having a diameter ranging from about 0.1 to 1.0 mm, but in the preferred embodiment of the present invention the Al wire is set to have a diameter of about 0.4 mm. The Al thin films 112, 113 formed by sputtering method have a thickness of greater than 0.1 μm for both. Moreover, the Al thin films 112, 113 may be replaced with a thick film with a thickness of greater than 10 μm, which is obtained by printing.

The filament F has a metal core wire coated with a ternary carbonate for electron emission, such as Ba, Sr or Ca, wherein the core wire in the present invention is made of tungsten or a tungsten alloy and has a width of about 0.4 MG (a diameter of about 14 μm). However, the core wire may have a width ranging from 0.3 MG (a diameter of about 10 μm) to 7.35 MG (a diameter of about 50 μm).

The spacer pad SP is fixedly attached to the front substrate 11 by ultrasonic-bonding the Al wire. When the spacer pad SP is fixed, the top portion SP3 has a height of 380 μm and the bottom portions of the fixing portions SP1, SP2 have a height of 230 μm. The height of the spacer pad 114 fixed to the front substrate 11, that is, the vertical position of the filament F is set to be 320 μm.

If the Al wire of the spacer pad SP has an uniform width, the heights of the fixing portions SP1, SP2 and the top portion SP3 thereof can be controlled by changing the ultrasonic output of an ultrasonic bonding device, the bonding time and the load of a bonding tool. The height of the spacer pad 114 can also be controlled in a similar fashion.

Pairs of the dampers D1, D2 are disposed to be apart from each other by a distance ranging from about 10 to 20 mm along a longitudinal direction of the filament F.

The dampers D1, D2 and the filament F preferably include a tension force apply portion (a spring portion) such as a coiled portion in order to apply the tension force thereto. Same is applied to the other preferred embodiments described below.

Referring to FIGS. 2A to 2H, the ultrasonic-bonding processes of the spacer pad SP and the dampers D1, D2 will now be described.

First, the spacer pad SP made of the Al wire is mounted on the Al thin film 112 formed on the front substrate 11 and then is pressed with an ultrasonic bonding tool (a wedge tool) T1 against the Al thin film 112. The ultrasonic is applied to the tool T1 so that the spacer pad SP is joined to the Al thin film 112 (see FIG. 2A). Thereafter, the damper D1 is mounted on thus fixed spacer pad SP and pressure is given to a part of the spacer pad SP and the damper D1 by using an ultrasonic bonding tool T2. By applying the ultrasonic to the tool T2, the damper D1 is joined to the spacer pad SP (see FIGS. 2B and 2C). The damper D1 is joined to the step-shaped fixing portion SP1 of the spacer pad SP. The extra portion of thus joined damper D1 is cut off (see FIG. 2D).

Figure 2A:
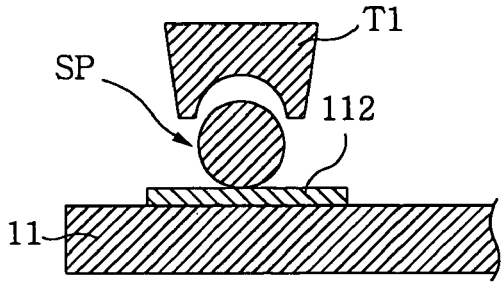
FIGS. 2A to 2H describe views for setting forth an ultrasonic bonding of a spacer pad and a damper in accordance with the preferred embodiment of the present invention.
Figure 2B:
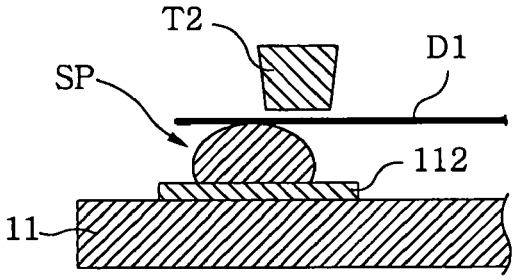
Figure 2C:
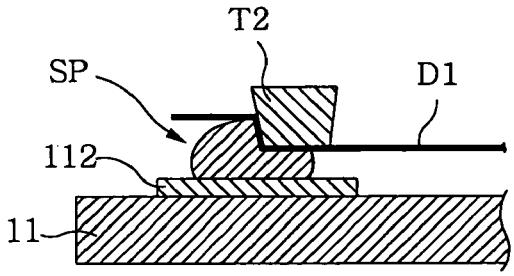
Figure 2D:
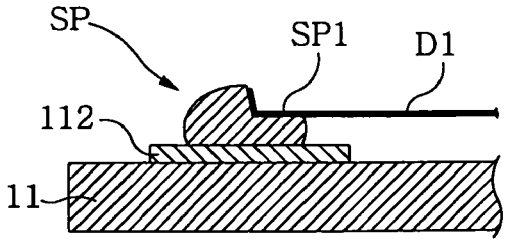
Figure 2E:
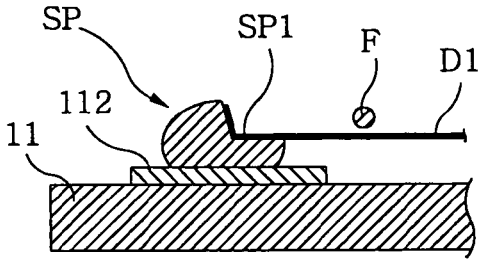
Figure 2F:
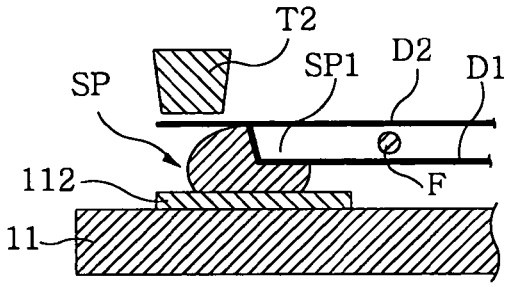
Figure 2G:
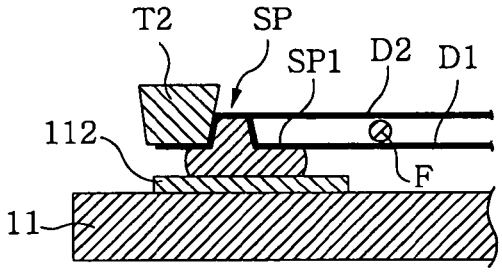
Figure 2H:
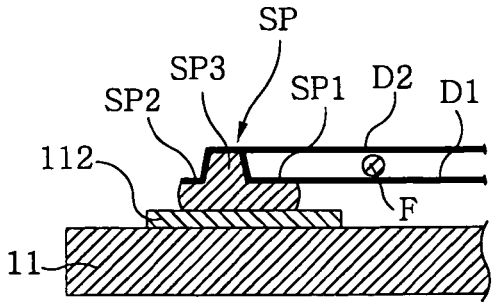

Next, the filament F is disposed not to be in contact with the damper D1 and then bonded to the spacer pad 114 shown in FIG. 1 (see FIG. 2E). Thereafter, the damper D2 is mounted on the spacer pad SP not to be in contact with the filament F and the ultrasonic is applied to the ultrasonic bonding tool T2 pressing another part of the spacer pad SP and the damper D2, thereby fixing the damper D2 to the spacer pad SP (see FIGS. 2F and 2G). The damper D2 is joined to the step-shaped fixing portion SP2 of the spacer pad SP. Finally, the extra portion of thus joined damper D2 is cut off so that the fixing process of the dampers D1, D2 is completed (see FIG. 2H).

Herein, the ultrasonic bonding was carried out under the condition where the output of the ultrasonic: 60 W, the load of the ultrasonic bonding tool: 600 g, and the bonding time: 50 m sec. The binding strength (a fixing strength) of the dampers D1, D2 is about 30 g, which is equal to or more than the line strength of the dampers D1, D2 (about 30 g).

FIGS. 3A to 3C and 4A to 4C illustrate the positions of the dampers D1, D2 fixed to the spacer pad SP in a manner to face to each other.

Figure 3A:
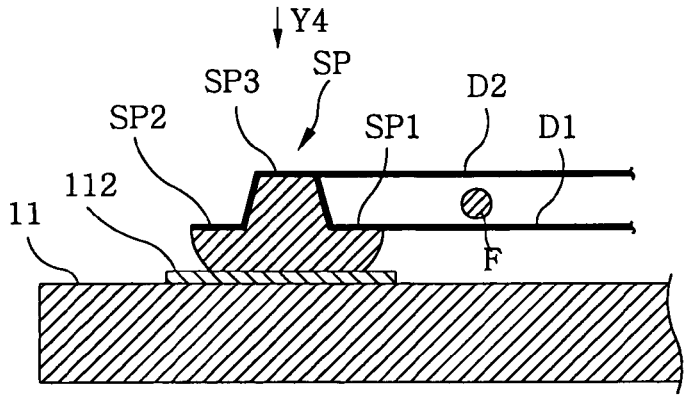
FIGS. 3A to 3C illustrate an example of fixing dampers arranged above and below a filament to the spacer pad to be disposed on a common vertical axis.
Figure 3B:
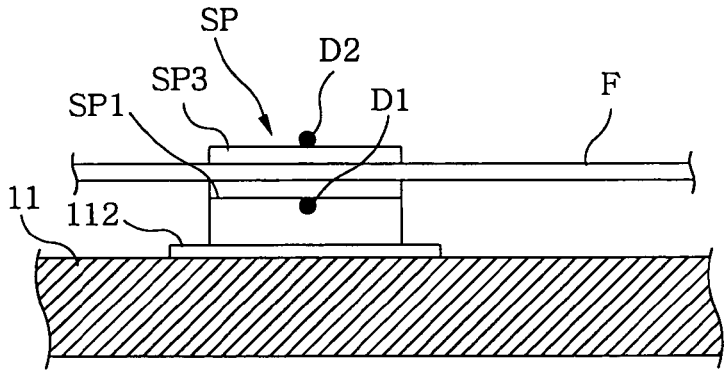
Figure 3C:
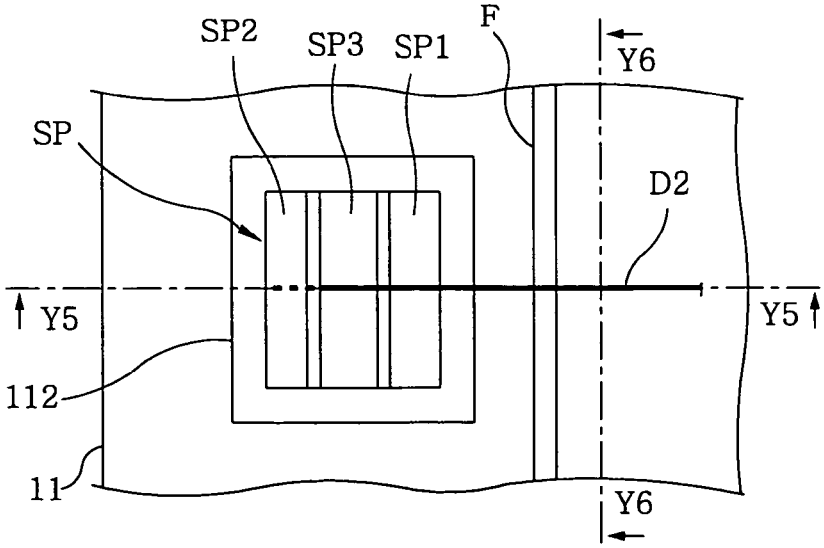
Figure 4A:
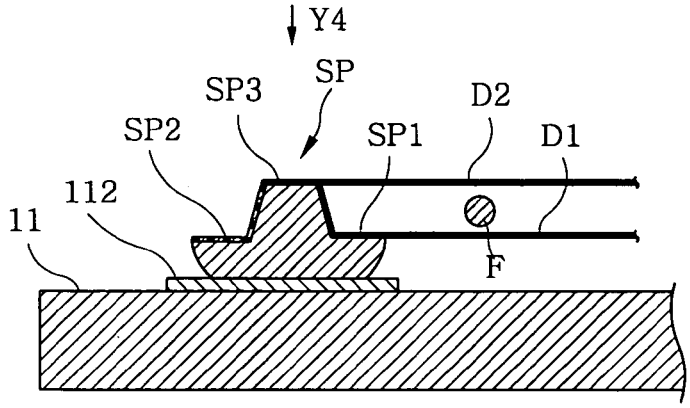
FIGS. 4A to 4C present another example of fixing the dampers arranged above and below the filament to the spacer pad to be disposed on different vertical axes from each other.
Figure 4B:
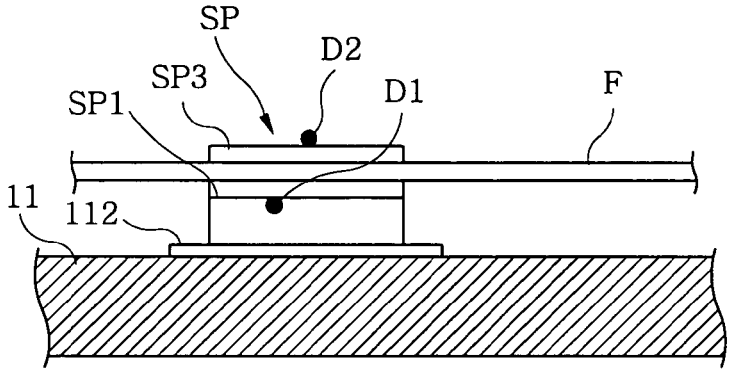
Figure 4C:
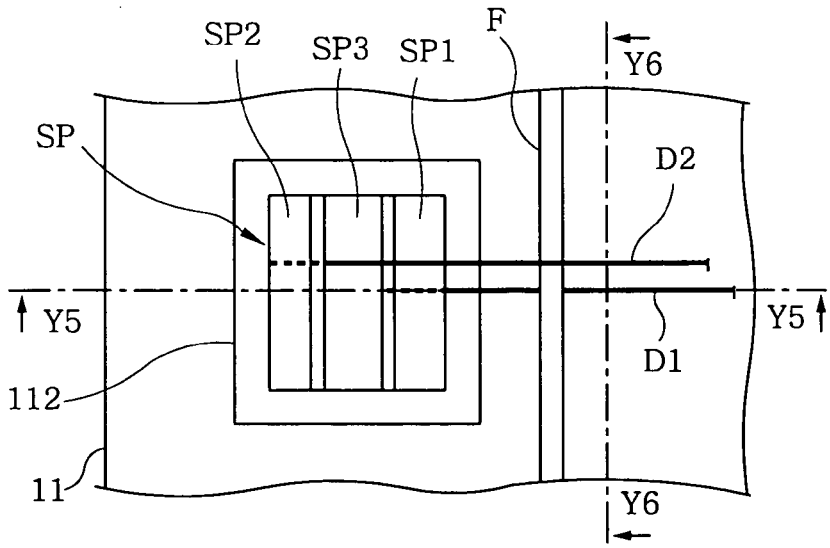

FIGS. 3A and 4A present cross sectional views seen in a direction indicated by arrows after taken along a line Y5—Y5 of FIGS. 3C and 4C, respectively; FIGS. 3B and 4B present cross sectional views seen in a direction indicated by arrows after taken along a line Y6—Y6 of FIGS.

3C and 4C, respectively; and FIGS. 3C and 4C offer top views seen in a direction indicated by arrow Y4 of FIGS. 3A and 4A, respectively.

In FIGS. 3A to 3C, the dampers D1, D2 are respectively arranged below and above the filament F in the intersecting direction thereof. The ends of the dampers D1, D2 are ultrasonic-bonded to the step-shaped fixing portions SP1, SP2, respectively, in a manner that the dampers D1, D2 are vertically, symmetrical with respect to a certain point of the filament F. The vertical positions of the dampers D1, D2 are defined by the heights of the fixing portion SP1, SP3, respectively.

In FIGS. 4A to 4C, the dampers D1, D2 are disposed below and above the filament F, respectively, in a manner not to vertically correspond to each other and then fixed to the spacer pad SP by the ultrasonic bonding.

It is possible to fix the damper D1 to the fixing portion SP2. In this case, the fixing portion of the damper D1 is leveled with or lower than the fixing portion SP2 shown in FIGS. 4A to 4C and the top portion for mounting thereon the damper D1 is lower than the top portion SP3 shown in FIGS. 4A to 4C and leveled with the bottom portion of the fixing portion SP1 shown in FIG. 4.

Such configurations illustrated in FIGS. 3 and 4 have the same effect in view of preventing the vibration of the filament F. Accordingly, it is not necessary to vertically align the dampers D1, D2 symmetrically about a certain point of the filament F while fixing the dampers D1, D2 to the spacer pad SP. Accordingly, the fixing process of the dampers can be carried out more easily.

Figure 5A:
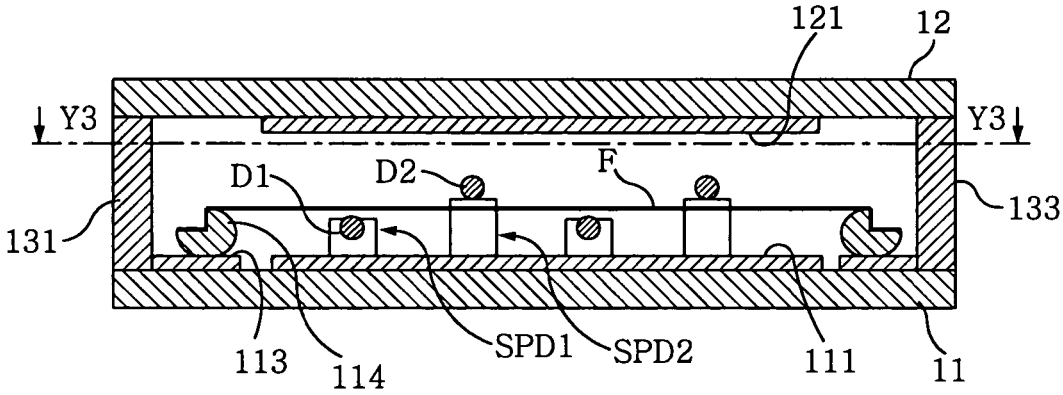
FIGS. 5A to 5C are views where the dampers arranged above and below the filament are fixed to the separate spacer pads prepared on a same substrate.
Figure 5B:
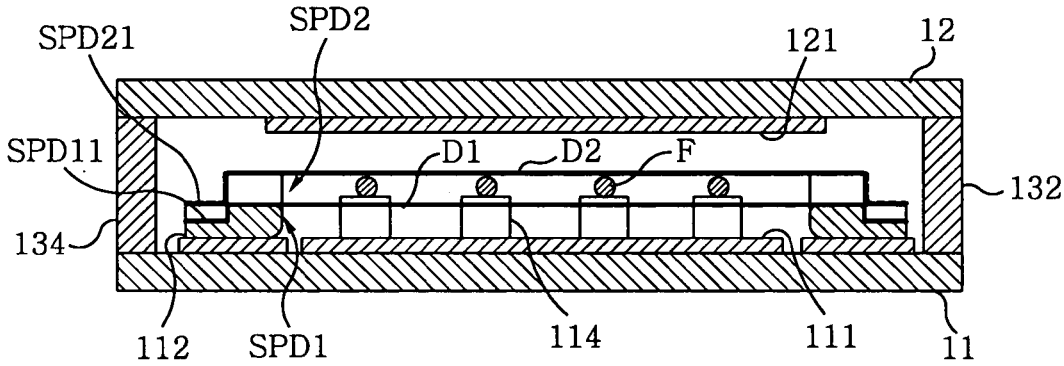
Figure 5C:
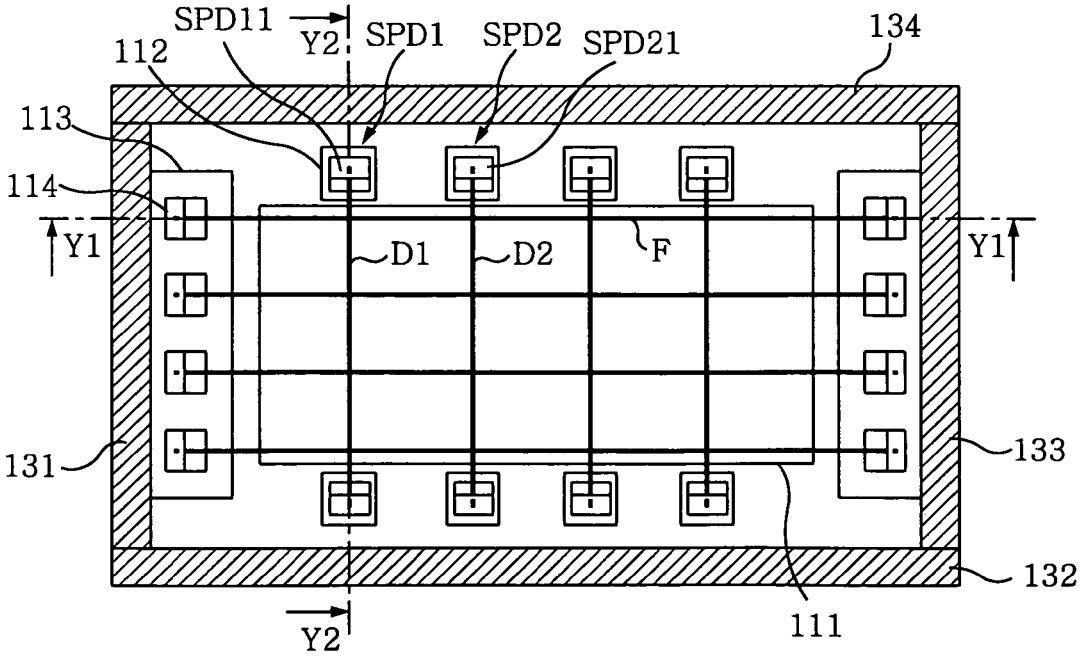

FIGS. 5A to 5C describe an example of fixing the dampers disposed above and below the filament to the spacer pads prepared on a same substrate, wherein FIG. 5A: a cross sectional view seen in a direction indicated by arrows after taken along a line Y1—Y1 of FIG. 5C, FIG. 5B: a cross sectional view seen in a direction indicated by arrows after taken along a line Y2—Y2 of FIG. 5C and FIG. 5C: a top view seen in a direction indicated by arrows after taken along a line Y3—Y3 of FIG. 5A.

The dampers D1, D2 (auxiliary linear members) are alternately arranged below and above the filament F (a linear member having auxiliary linear members therebelow and thereabove), respectively. Then the damper D1 is fastened to a lower spacer pad SPD1 (a fixing member) and the damper D2 is fixed to an upper spacer pad SPD2 (a fixing member). One end of the damper D1 is joined to a step-shaped fixing portion SPD11 of the lower spacer pad SPD1 by using the ultrasonic bonding. In the same manner, the end of the damper D2 is ultrasonic-bonded to a step-shaped fixing portion SPD21 of a spacer pad SPD2. The spacer pads SPD1, SPD2 are fixedly attached to the corresponding Al thin films 112 (metal layers) on the front substrate 11 (a same substrate) by the ultrasonic bonding.

In this case, more spacer pads are needed but the number of the dampers used therefor is reduced. Moreover, since each of the spacer pads SPD1, SPD2 has only one damper D1, D2 fixed thereto, there can be secured a large ultrasonic boding space for each damper, thereby obtaining the increasing binding strength.

FIGS. 6A to 6C and 7A to 7C depict an intermediate spacer pad disposed at the middle point of the damper.

Figure 6A:
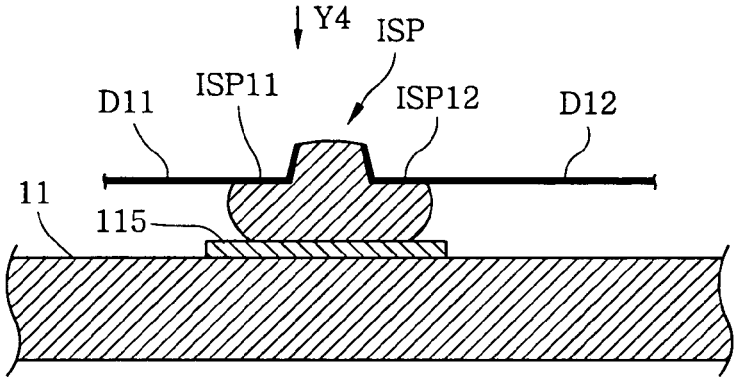
FIGS. 6A to 6C show an example of installing an intermediate spacer pad at the middle point of the damper.
Figure 6B:
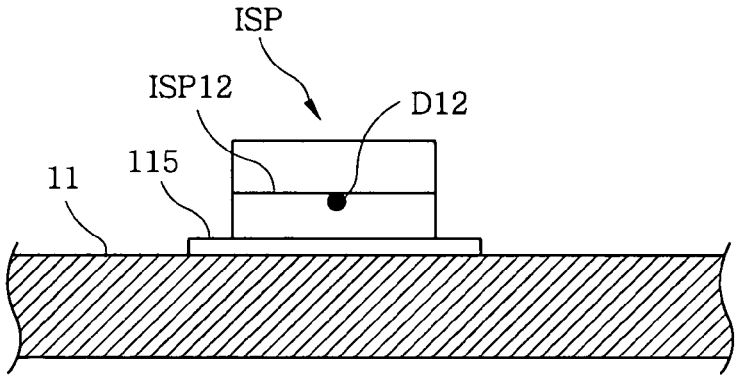
Figure 6C:
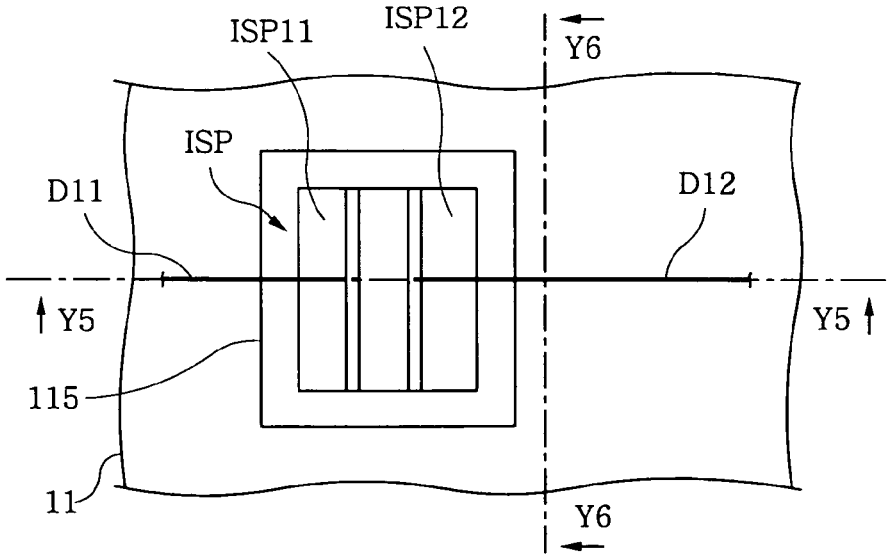
Figure 7A:
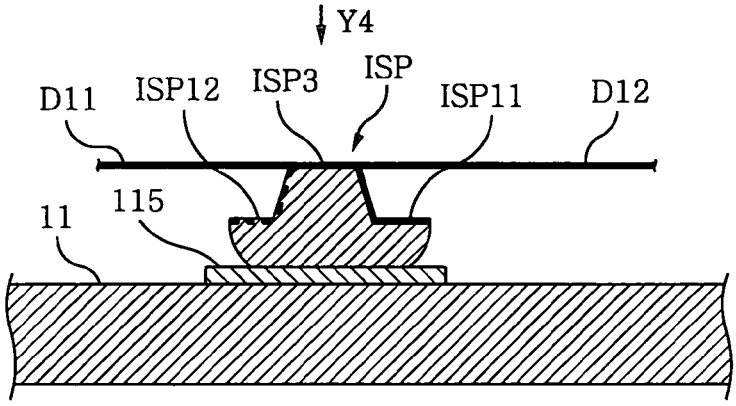
FIGS. 7A to 7C offer another example of installing the intermediate spacer pad at the middle portion of the damper.
Figure 7B:
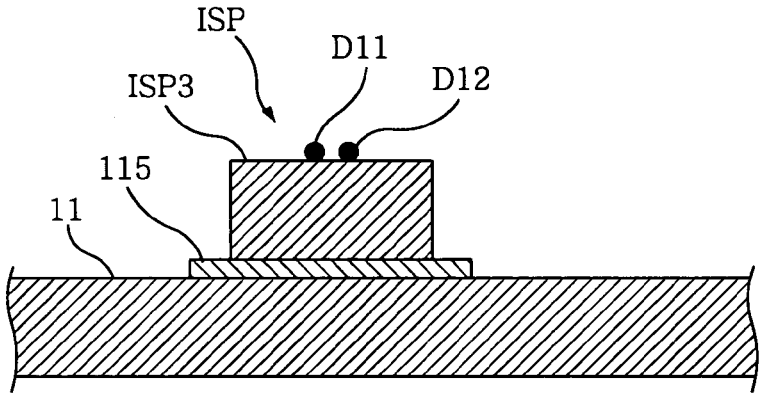
Figure 7C:
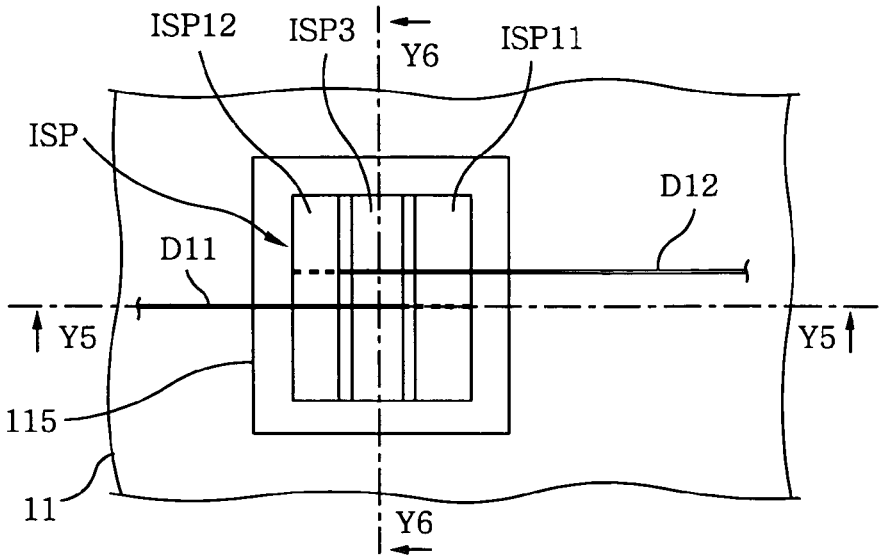

FIGS. 6A and 7A are cross sectional views seen in a direction indicated by arrows after taken along a line Y5—Y5 of FIGS. 6C and 7C, respectively; FIGS. 6B and 7B, cross sectional views seen in a direction indicated by arrows after taken along a line Y6—Y6 of FIGS. 6C and 7C, respectively; and FIGS. 6C and 7C, top views seen in a direction indicated by an arrows Y4 shown of FIG. 6A and 7A, respectively.

In FIGS. 6A to 6C, a conductive intermediate spacer pad ISP is fixedly attached to an Al thin film 115 (a metal layer) of the front substrate 11 (a same substrate) by using the ultrasonic bonding. Then dampers D11, D12 (a plurality of auxiliary linear members) are fixed to the intermediate spacer pad ISP (a fixing member) in such a manner that one of the dampers D11, D12 extends to the right and the other extends to the left therefrom. The ends of the dampers D11, D12 are ultrasonic-bonded to their corresponding step-shaped fixing portions ISP11, ISP12. The dampers D11, D12 have the same vertical position which is determined by the height of bottom portions of the fixing portions ISP11, ISP12.

In general, the intermediate spacer pad is useful in case of the lengthy damper. However, in most cases, the pad is installed in the display area and, therefore, the smallest installation space therefor is preferable. The spacer pad ISP of FIGS. 6A to 6C has an advantage in point of the installation space because only one spacer pad ISP is installed for both dampers D11, D12.

In FIGS. 7A to 7C, the filament F (not shown) has the dampers D11, D12 shifted to each other in a longitudinal direction thereof. The end of the damper D11 is bonded to the fixing portion ISP11 by using the ultrasonic bonding and that of the damper D12 is bonded to the fixing portion ISP12 by the same way. The vertical positions of the dampers D11, D12 are defined by the height of a top portion ISP3.

There are described in FIGS. 6A to 6C and 7A to 7C the description of fastening the lengthy damper tightly. However, it may be applied to other lengthy linear members such as a filament or a wire grid for the purpose of tightly fastening same.

Figure 8:
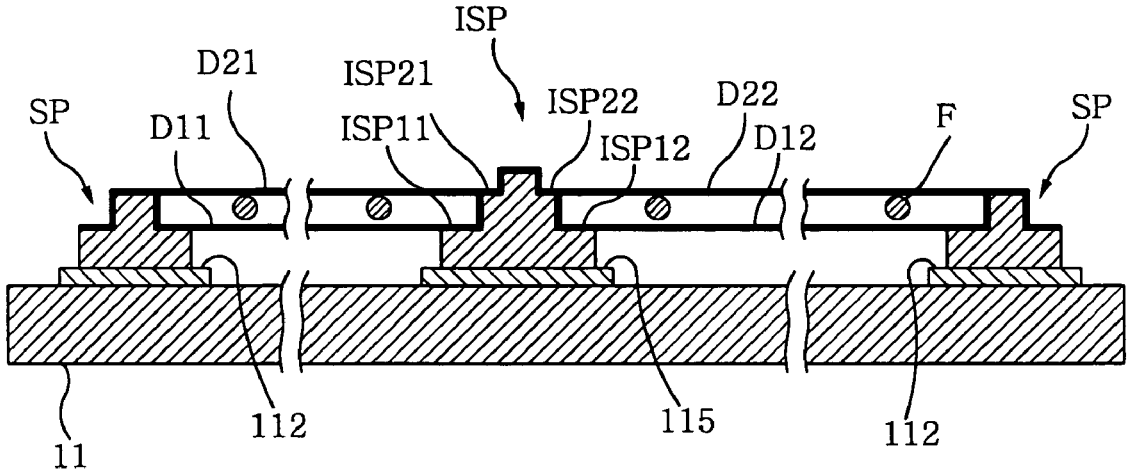
FIG. 8 is an example of providing a common intermediate spacer pad for the dampers arranged above and below the filament.

FIG. 8 shows an example of the intermediate spacer pad for fixing the corresponding dampers placed respectively below and above the filament.

The intermediate spacer pad ISP has a three-stepped structure where the first and the second steps from the bottom constitute the fixing portions. One end of each dampers D11, D12 is ultrasonic-bonded to the lower fixing portions ISP11, ISP12, respectively, while that of each dampers D21, D22 is ultrasonic-bonded to upper fixing portions ISP21, ISP22, respectively. The other ends of the respective dampers D11, D12, D21, D22 are fixed to the spacer pads SP, respectively, by using the ultrasonic bonding.

Figure 9A:
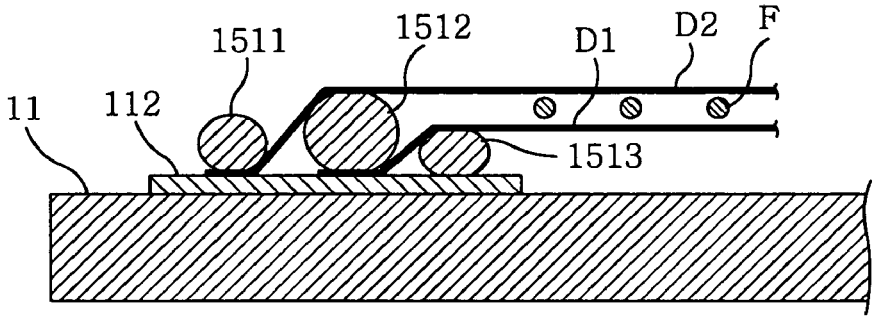
FIGS. 9A and 9B offer views where separated spacers are prepared for the respective dampers arranged above and below the filament.
Figure 9B:
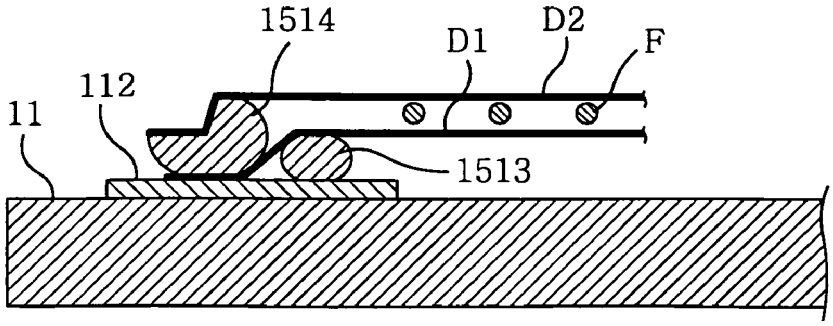

In FIGS. 9A and 9B, a pair of dampers disposed above and below the filament in the cross direction thereof are fixed to the same substrate by using separate spacers for each damper.

First, the structure depicted in FIG. 9A will now be explained. The end of the damper D1 (a lower auxiliary linear member) is bonded to the Al thin film 112 (a metal layer) on the front substrate 11 (a base) by applying the ultrasonic to an Al wire 1512 (a fixing member and spacer member). Similarly, the end of the damper D2(an upper auxiliary linear member) is bonded to the Al thin film 112 by applying the ultrasonic to an Al wire 1511 (a fixing member). Thus, the two dampers are fixed to the same Al thin film 112. The Al wire 1512 also functions as a spacer for the damper D2. The reference numeral 1513 represents a spacer for the damper D1.

In FIG. 9A, the Al wire 1512 performs a double duty as the fixing member of the damper D1 or the spacer of the damper D2, thereby saving the installation of any one of the fixing member and the spacer in comparison with the case of fixing both dampers to the separate fixing members.

Next, the structure of FIG. 9B will now be described. The end of the damper D1 (a lower auxiliary linear member) is bonded to the Al thin film 112 (a metal layer) by applying the ultrasonic to an Al wire 1514 (a fixing member), while the end of the damper D2 (an upper auxiliary linear member) is bonded to a step-shaped fixing portion of the Al wire 1514 by using the ultrasonic bonding, so that the two dampers are fixed to the common Al thin film 112 formed on the front substrate 11 (a base).

In this case, the Al wire 1514 is a fixing member of the damper D1. At the same time the Al wire 1514 serves both as the spacer member and the fixing member of the damper D2. Therefore, the Al wire 1511 shown in FIG. 9A is not necessary.

In the examples illustrated in FIGS. 9A and 9B, the dampers D1, D2 can be fixed to the same substrate, thereby facilitating the fixing process. Moreover, the fixing member of one damper can also be used as the spacer of the other damper so that the number of the spacers or the fixing members can be reduced.

Figure 10:
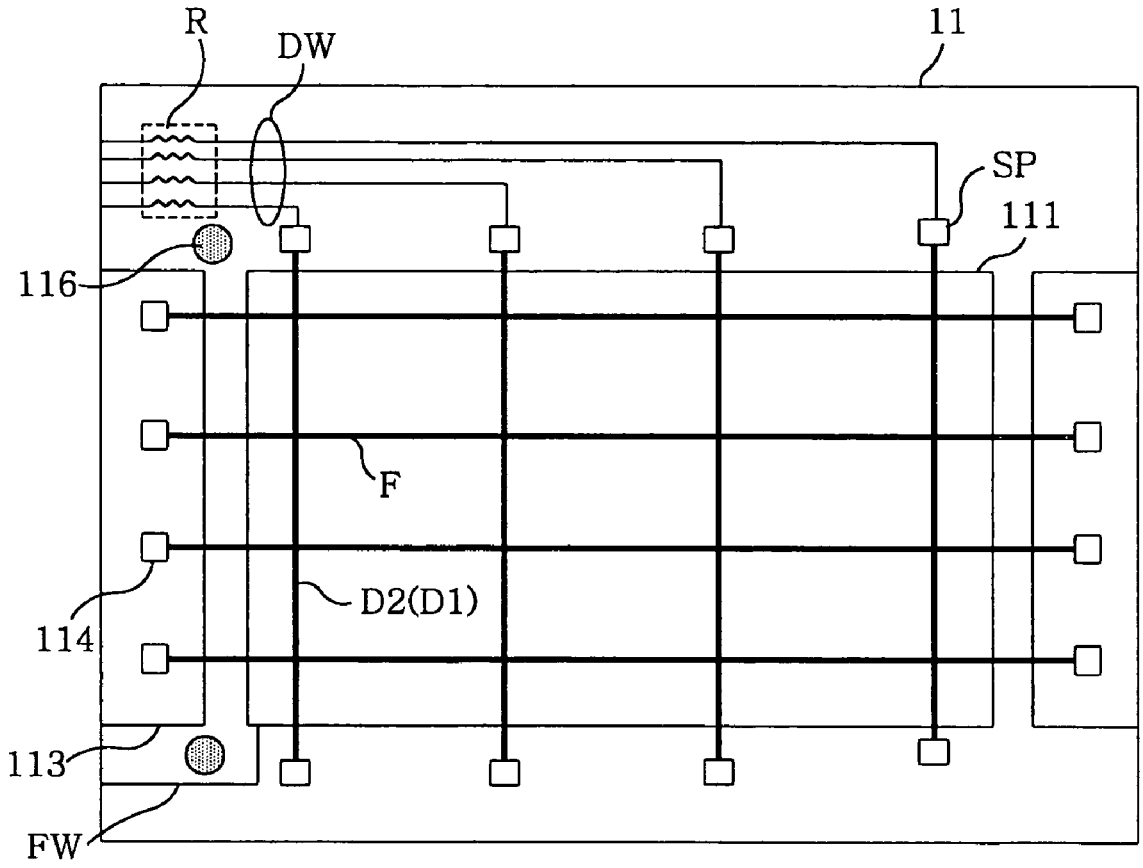
FIG. 10 illustrates an arrangement of the wirings on a front substrate in accordance with the preferred embodiment of the present invention.
Figure 11A:
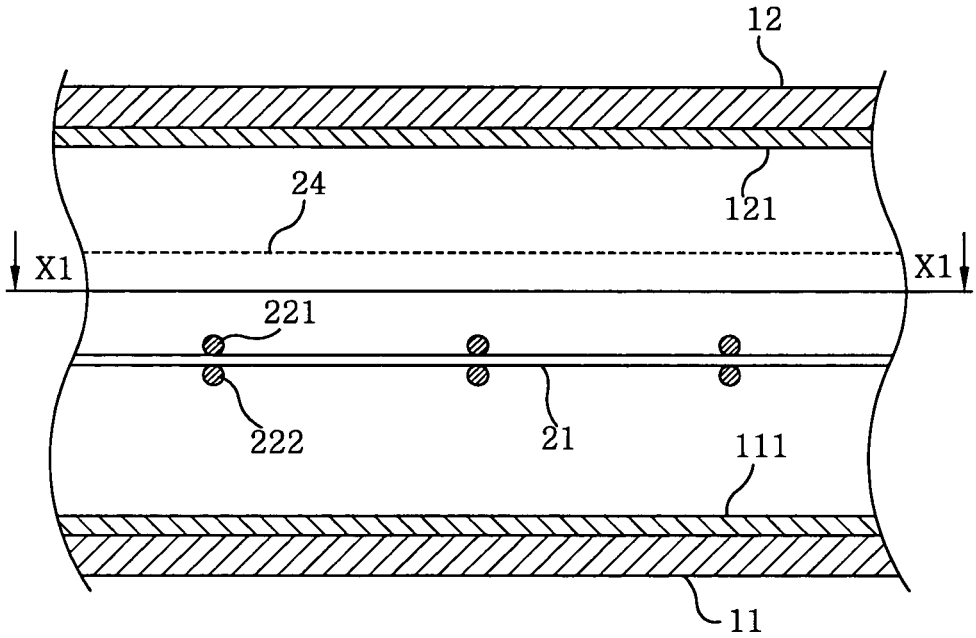
FIG. 11A (PRIOR ART)
FIGS. 11A and 11B present a cross sectional view of the conventional fluorescent display tube and a top view thereof, respectively.
Figure 11B:
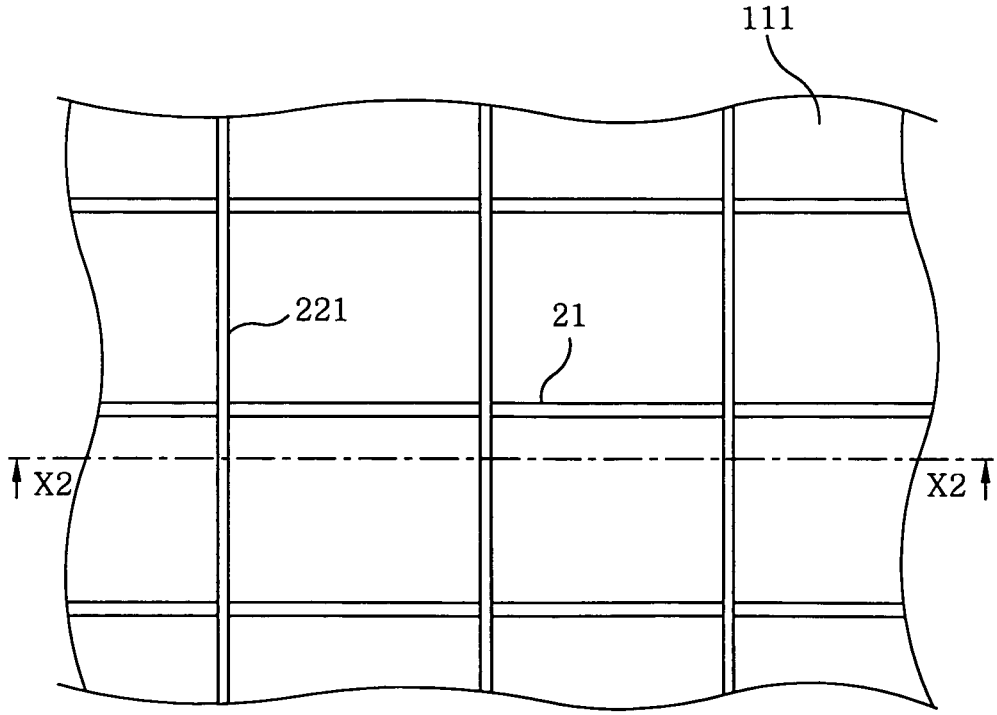
FIG. 11B (PRIOR ART)
Figure 12A:
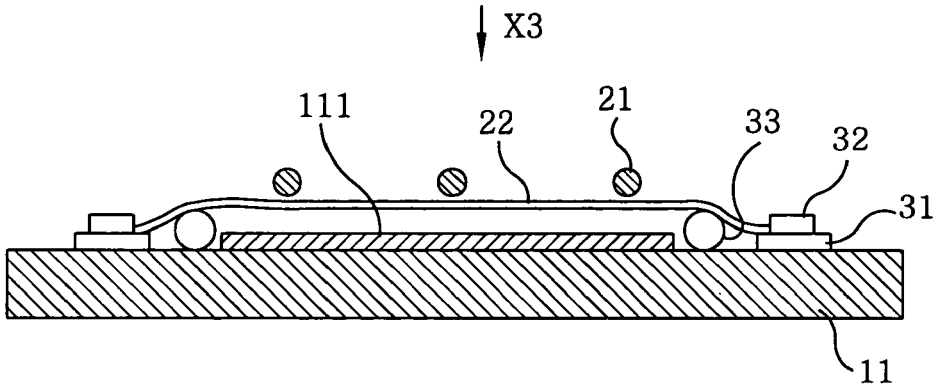
FIG. 12A (PRIOR ART)
FIGS. 12A and 12B describe a fixing method of a damper disposed at one side of filaments in another conventional fluorescent display tube.
Figure 12B:
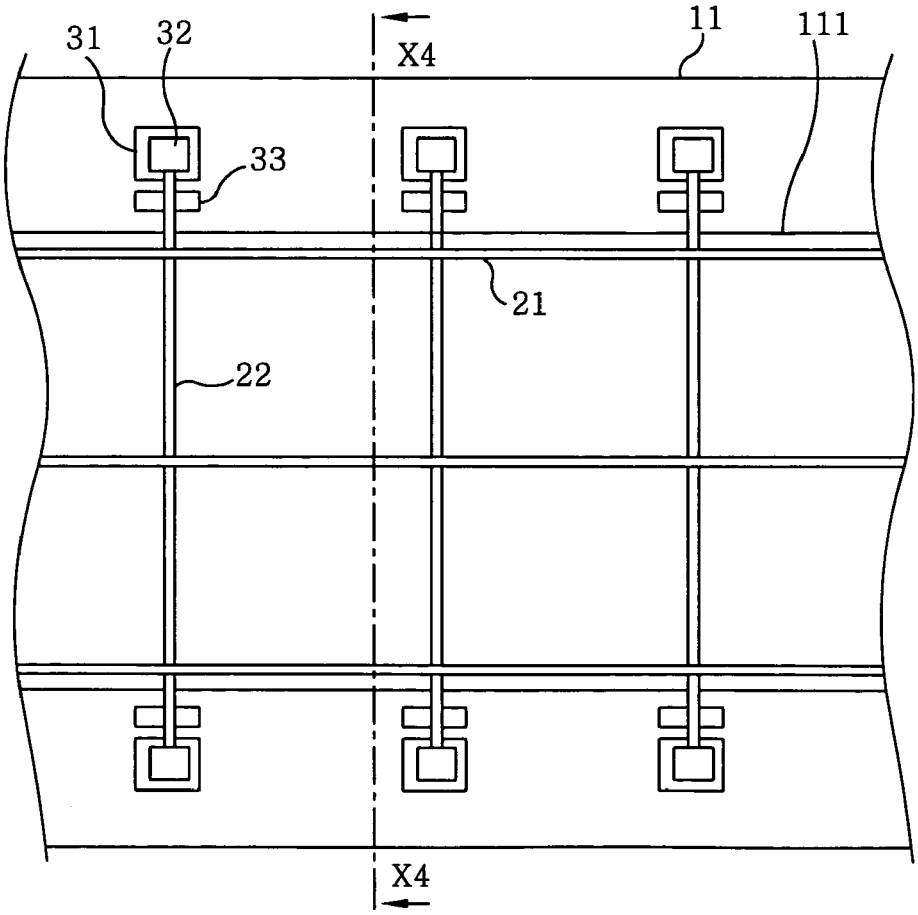
FIG. 12B (PRIOR ART)
Figure 13:
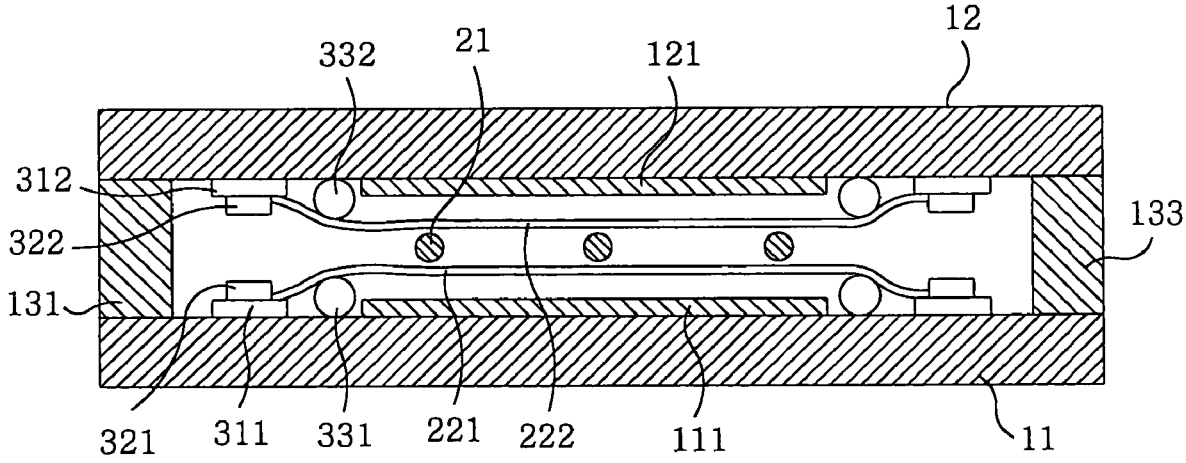
FIG. 13 sets forth the fixing method of the dampers arranged above and below the filament, wherein the method is conceived based on the fixing method of the conventional display tube shown in FIGS. 12A and 12B.

There is described in FIG. 10 an arrangement of wirings prepared on the front substrate 11.

Formed in a flat shape on the front substrate 11 is the transparent conductive film 111, to which a wiring FW is connected. The filament F has the plurality of pairs of corresponding dampers D1, D2 arranged respectively below and above the filament. Each pair is connected to a wiring DW which is connected to a resistor R. While the filament F comes into contact with the dampers D1, D2, the resistor R prevents a current of the filament F from flowing into the dampers D1, D2. Further, the Al thin film 113 serves as a cathode wiring. The reference numeral 116 represents a getter.

In this case, since a single wiring DW works for both dampers D1, D2 arranged below and above the filament F, the number of the wirings is reduced by half, compared with the case of connecting the wiring DW to each damper. Further, the number of the terminals (not shown) connected to the wirings DW is also halved.

Though the damper and the spacer pad for the filament are made of the Al wire in the preferred embodiment of the present invention, the material thereof is not limited to aluminum. A metal such as Cu, Au, Ag, Ni, Pt or V, suitable for fabricating and bonding can be employed therefor. Further, the cross sectional shape of the spacer pad is not limited to the circular or the elliptical shape. It may be a rectangular shape or the like. As the material of the thin film for fixing the spacer pad, aluminum is employed but any one of Cu, Au, Ag, Ni, Pt and V can be adopted instead of aluminum. Further, the Al thin film can be formed at the surface of the sealed vessel or on the components in the vessel via an insulating layer. The Al thin film is not limited to the thin film and may be a thick film made of a metal. Therefore, it is referred to as a metal layer in the present invention.

Furthermore, it is preferable that the spacer pad and the metal layer are made of the similar metallic material (e.g., Al and Al alloy) in terms of the binding strength. Most preferably, they are made of the same metallic material (e.g., Al alloy and Al alloy).

The above-described spacer pad used to fix the damper in the preferred embodiment, is not limited thereto, and it may be used to fix other linear members such as the filament and the wire grid. Further, though there are disposed a plurality of linear members in the preferred embodiment, only one linear member can be employed.

A pair of dampers are fixed to the same spacer pad on the same substrate in the preferred embodiment, but two or more pairs of dampers can be fixed thereto.

In the preferred embodiment, the ultrasonic bonding technique is used to fix the members but another technique may be employed therefor.

Furthermore, dampers are fixed to the front substrate in the preferred embodiment but they may be fixed to the anode substrate, the side plate, the electrode substrate(e.g., grid intermediate substrate in the sealed vessel) or the components in the sealed vessel.

Though the end of the linear member is placed in the outer end potion of the conductive spacer in the preferred embodiment, the location thereof is not limited thereto if the linear member can be fixed.

The fixing portion for fixing the dampers are formed at the end portion of the spacer pad, but it may be formed at another location, e.g., the intermediate portion thereof.

There are described the fluorescent display tube in the present invention, but it may be, a display tube such as a fluorescent radiation device or a CRT, a discharge tube such as a hot cathode discharge tube or an electron tube such as a vacuum tube.

In accordance with the present invention, the auxiliary linear members are fixed to the same fixing member or the separated fixing members prepared on the same substrate, so that the installation space thereof can be smaller and the fixing process can be simplified. Further, fewer fixing members of the auxiliary linear members are needed. The reduction in the number of the wirings for the auxiliary linear member and the terminals for extracting the wirings can be obtained.

In the present invention, one or more pairs of corresponding dampers symmetrically arranged above and below the linear member such as the filament are fixed to the same or the separate fixing member(s) formed on any one of the front substrate and the anode substrate so that the installation space of the auxiliary linear members can be reduced and the fixing process can be simplified. Further, the number of the fixing members is reduced together with the number of the wirings of the dampers and terminals for extracting the wirings.

Further, the dampers symmetrically disposed above and below the linear member such as the filament can be fixed to the same substrate and, further, both dampers are fixed to the same spacer pad. In this case, one spacer pad can be used for the pair of dampers and perform double duty as the fixing member or the spacer. Accordingly, the space for fixing the dampers can be smaller, thereby realizing a small size of a fluorescent radiation device. Moreover, the dampers can be fixed to the same substrate so that the fixing process can be facilitated. One spacer pad can be used for both dampers and can serve a dual function as the fixing member or the spacer with the results that: fewer spacers or fixing members of the dampers are needed and, accordingly, fewer metal layers for fixing same are used; and the processes including the fixing process of the spacers or fixing members and the manufacturing process of the metal layers can be reduced.

Since the end of the damper is joined to the step-shaped fixing portion along the bottom portion and the vertical portion thereof, the damper can have sufficient amount of portion joined to the spacer pad to thereby heighten the binding strength. Further, by forming the fixing portions at different locations in the spacer pad, there can be formed in the spacer pad a plurality of spacers with different heights.

In case of connecting the wiring to the damper, the wiring can be used for a pair of corresponding dampers and, therefore, it is unnecessary to increase the number of the wirings and the terminals for extracting the wirings.

In accordance with the present invention, the dampers and the spacer pads are fixed by using the ultrasonic bonding technique, which does not generate heat during the fixing process, compared with the case of the other technique (e.g., welding technique). Accordingly, damages to neighboring components due to the heat can be prevented.

While the invention has been shown and described with respect to the preferred embodiments, it will be understood by those skilled in the art that various changes and modifications may be made without departing from the spirit and scope of the invention as defined in the following claims.

What is claimed is:

1. An electron tube comprising:

a vessel;

a primary linear member installed in the vessel;

an electrode disposed in the vessel;

a first auxiliary linear member and a second auxiliary linear member disposed at different heights to interpose the primary linear member therebetween; and a plurality of fixing members, formed at a single substrate constituting a part of the vessel, for fixing end portions of the first auxiliary and the second auxiliary linear member thereto, wherein two end portions of each auxiliary linear member are fixed to two different fixing members, respectively.

2. The electron tube of claim 1, wherein the first and the second auxiliary linear member are fixed to the fixing members by embedding therein at least parts of the end portions thereof.

3. The electron tube of claim 1, further comprising a number of metal layers formed at the substrate, and wherein the fixing members are fixedly attached to the metal layers by an ultrasonic bonding method, and the end portions of the first and the second auxiliary linear member are fixedly attached to the fixing members by the ultrasonic bonding method.

4. The electron tube of claim 1, wherein the first and the second auxiliary linear member are arranged in a direction intersecting the primary linear member, and wherein the fixing members include spacer pads determining the heights of the auxiliary linear members, the spacer pads being fixed to the substrate via metal layers formed thereat, and one end portion of the first auxiliary linear member and one end portion of the second auxiliary linear member are fixed to one spacer pad.

5. The electron tube of claim 4, wherein said one end portion of the first auxiliary linear member and said one end portion of the second auxiliary linear member are fixed at different locations of said one spacer pad.

6. The electron tube of claim 4, wherein the other end portions of the first and the second auxiliary linear member are fixed to another spacer pad to face each other.

7. The electron tube of claim 1, wherein the first and the second auxiliary linear member are arranged in a direction intersecting the primary linear member, and wherein the fixing members include spacer pads determining the heights of the auxiliary linear members, the spacer pads being fixed to the substrate via metal layers formed thereat, and the end portions of the auxiliary linear members are fixed to different spacer pads, respectively.

8. An electron tube comprising:

a vessel;

a primary linear member installed in the vessel;

an electrode disposed in the vessel;

a first auxiliary linear member and a second auxiliary linear member disposed at different heights to interpose the primary linear member therebetween; and a plurality of fixing members, formed at a single substrate constituting a part of the vessel, for fixing end portions of the first auxiliary and the second auxiliary linear member thereto, wherein the first and the second auxiliary linear member are arranged in a direction intersecting the primary linear member, wherein the fixing members include spacer pads determining the heights of the auxiliary linear members, the spacer pads being fixed to the substrate via metal layers formed thereat, and the end portions of the auxiliary linear members are fixed to different spacer pads, respectively, and the electron tube further comprising at least one additional first auxiliary linear member and at least one additional second auxiliary linear member, and wherein the first auxiliary linear members of a first height and the second auxiliary linear members of a second height are alternately disposed along a length direction of the primary linear member.

9. The electron tube of claim 1, further comprising a metal layer formed at the substrate, and wherein the first and the second auxiliary linear member are arranged in a direction intersecting the primary linear member, and wherein a fixing member for fixing one end portion of the first auxiliary linear member serves as a spacer member of the second auxiliary linear member for determining a height thereof, said fixing member being fixed to the metal layer.

10. The electron tube of claim 9, wherein said fixing member and a fixing member for fixing one end portion of the second auxiliary linear member are fixed to the metal layer.

11. The electron tube of claim 1, wherein the primary linear member and the auxiliary linear members are disposed parallel to the single substrate.

12. The electron tube of claim 1, further comprising:

a plurality of fixing members, formed at the single substrate, for fixing end portions of the primary linear member thereto.

13. An electron tube comprising:

a vessel;

a primary linear member installed in the vessel;

an electrode disposed in the vessel;

a first auxiliary linear member and a second auxiliary linear member disposed at different heights to interpose the primary linear member therebetween; and a plurality of fixing members, formed at a single substrate constituting a part of the vessel, for fixing end portions of the first auxiliary and the second auxiliary linear member thereto, wherein the primary linear member and the auxiliary linear members are disposed parallel to the single substrate.

14. The electron tube of claim 13, wherein the first and the second auxiliary linear member are fixed to the fixing members by embedding therein at least parts of the end portions thereof.

15. The electron tube of claim 13, further comprising a number of metal layers formed at the substrate, and wherein the fixing members are fixedly attached to the metal layers by an ultrasonic bonding method, and the end portions of the first and the second auxiliary linear member are fixedly attached to the fixing members by the ultrasonic bonding method.

16. The electron tube of claim 13, wherein the first and the second auxiliary linear member are arranged in a direction intersecting the primary linear member, and wherein the fixing members include spacer pads determining the heights of the auxiliary linear members, the spacer pads being fixed to the substrate via metal layers formed thereat, and one end portion of the first auxiliary linear member and one end portion of the second auxiliary linear member are fixed to one spacer pad.

17. The electron tube of claim 16, wherein said one end portion of the first auxiliary linear member and said one end portion of the second auxiliary linear member are fixed at different locations of said one spacer pad.

18. The electron tube of claim 16, wherein the other end portions of the first and the second auxiliary linear member are fixed to another spacer pad to face each other.

19. The electron tube of claim 13, wherein the first and the second auxiliary linear member are arranged in a direction intersecting the primary linear member, and wherein the fixing members include spacer pads determining the heights of the auxiliary linear members, the spacer pads being fixed to the substrate via metal layers formed thereat, and the end portions of the auxiliary linear members are fixed to different spacer pads, respectively.

20. The electron tube of claim 13, further comprising a metal layer formed at the substrate, and wherein the first and the second auxiliary linear member are arranged in a direction intersecting the primary linear member, and wherein a fixing member for fixing one end portion of the first auxiliary linear member serves as a spacer member of the second auxiliary linear member for determining a height thereof, said fixing member being fixed to the metal layer.

21. The electron tube of claim 20, wherein said fixing member and a fixing member for fixing one end portion of the second auxiliary linear member are fixed to the metal layer.

22. The electron tube of claim 13, further comprising:

a plurality of fixing members, formed at the single substrate, for fixing end portions of the primary linear member thereto.

23. The electron tube of claim 8, wherein two end portions of each auxiliary linear member are fixed to two different fixing members, respectively.

24. The electron tube of claim 8, wherein the primary linear member and the auxiliary linear members are disposed parallel to the single substrate.

25. The electron tube of claim 8, further comprising:

a plurality of fixing members, formed at the single substrate, for fixing end portions of the primary linear member thereto.

* * * * *